US007025530B2

(12) United States Patent
Beamish et al.

(10) Patent No.: US 7,025,530 B2
(45) Date of Patent: Apr. 11, 2006

(54) ROAD MATS

(76) Inventors: Shawn Beamish, 8308-93 Avenue, Edmonton, Alberta (CA) T5N3M6; Kelly Sparrow, #5 Newport Drive, Sherwood Park, Alberta (CA) T6C1T6

( * ) Notice: Subject to any disclaimer, the term of this patent is extended or adjusted under 35 U.S.C. 154(b) by 0 days.

(21) Appl. No.: 10/677,840

(22) Filed: Oct. 1, 2003

(65) Prior Publication Data

US 2004/0175233 A1 Sep. 9, 2004

(30) Foreign Application Priority Data

Jan. 3, 2003 (CA) ..... 2414518

(51) Int. Cl.
*E01C 5/22* (2006.01)

(52) U.S. Cl. ..... 404/41; 404/35; 404/36

(58) Field of Classification Search ..... 404/41, 404/42, 46, 47, 57, 58, 50, 34, 35, 40, 29, 404/36; 14/2.6, 69.5
See application file for complete search history.

(56) References Cited

U.S. PATENT DOCUMENTS

| | | | | | |
|---|---|---|---|---|---|
| RE18,188 | E | * | 9/1931 | Rush | 404/50 |
| 2,038,605 | A | * | 4/1936 | Robertson | 404/55 |
| 2,311,286 | A | * | 2/1943 | Tufts | 404/50 |
| 2,321,067 | A | * | 6/1943 | De Witt | 404/50 |
| 2,716,373 | A | * | 8/1955 | Scrivner et al. | 404/50 |
| 3,202,067 | A | * | 8/1965 | Michard et al. | 404/17 |
| 3,397,496 | A | * | 8/1968 | Sohns | 52/286 |
| 3,859,000 | A | * | 1/1975 | Webster | 404/41 |
| 4,286,410 | A | * | 9/1981 | Hahn | 49/33 |
| D332,148 | S | * | 12/1992 | Tal et al. | D25/138 |
| 5,234,204 | A | | 8/1993 | Hunt | |
| 5,357,727 | A | * | 10/1994 | Duckworth et al. | 52/396.06 |
| 5,862,983 | A | * | 1/1999 | Andrus et al. | 238/14 |
| 5,924,152 | A | * | 7/1999 | Maier | 14/2.4 |
| 5,971,655 | A | * | 10/1999 | Shirakawa | 404/40 |
| 6,733,206 | B1 | | 5/2004 | Stasiewich et al. | |
| 2002/0176744 | A1 | | 11/2002 | Stasiewich et al. | |
| 2002/0176745 | A1 | | 11/2002 | Stasiewich et al. | |

FOREIGN PATENT DOCUMENTS

CA 2348328 A1 2/2002

* cited by examiner

*Primary Examiner*—Raymond W. Addie
(74) *Attorney, Agent, or Firm*—Law Office of Karen Dana Oster, LLC

(57) ABSTRACT

A road mat having a mat body with a first coupling end and a second coupling end. A first locking mechanism is provided at the first coupling end that includes a male coupling member and a female coupling member. A second locking mechanism is provided at the second coupling end that includes a male coupling member and a female coupling member. In one preferred embodiment of the present invention the first locking mechanism is a reciprocating mirror image of the second locking mechanism. The road mat of the present invention may be used in a road mat system that includes at least one prior road mat and at least one successive road mat. The second locking mechanism of the prior road mat is suitable for interlocking with the first locking mechanism of the successive road mat.

34 Claims, 3 Drawing Sheets

ROAD MATS

The present application claims the benefit of the filing date of Canadian Patent Application Number 2,414,518, filed Jan. 3, 2003, under the provisions of 35 U.S.C. 119.

BACKGROUND OF INVENTION

The present invention relates to a road mat.

Most known road mats are limited to large square or rectangular mats that are designed to be laid directly onto a ground surface prior to being driven over by vehicles and equipment. These mats see such service in areas where it is prohibitively expensive to develop a full-scale roadway and where access is required and time sensitive, as well as in environmentally sensitive areas where development of a full-scale roadway is simply not feasible due to regulations and/or environmental concerns. These known road mats are limited by their ability to provide some form of highly secure mechanical interlocking mechanism to prevent the shifting of the mats while being traversed by heavy equipment. If the mats shift for any reason and become unhinged, substantial damage may occur to the traversing equipment. Further, such shifting requires maintenance of the mats, substantially increasing transportation costs.

Common road mats are mainly large steel and wooden mats that are designed to be laid over the surface to be traversed. Such mats generally use a rudimentary L or J shaped reversing or reciprocating style end joint or coupling end that is easily joined upon placement but provides for very limited and inherently insecure interlocking capability. Such imprecise designs afford numerous difficulties upon removal, this mainly due to the collection of debris in the sloppy or loose mating joints.

Canadian Patent Number 2,348,328 is directed to a road mat designed to be laid on a ground surface in end to end relation and driven over by a motor vehicle. The mats are secured together by interlocking the first coupling of one road mat with the second coupling of another, adjacent road mat. The second coupling is adapted to engage the first coupling such that a retaining lip of the second coupling engages a retaining lip of the first coupling to prevent separation. Because there is a gap between the couplings, the road mat shown and described in this reference suffers from many of the problems suffered by other prior art.

Although some of the prior art road mats provide for a limited interlocking capability, the known road mats have one or more of the following problems: they are restricted in their ability to interlock; they do not provide for an even surface when placed on undulating sub soils; they do not provide for load dispersal and weight transfer between the structures; and they are not designed for ease of installation and removal, i.e.: unlocking. A further deficit of prior art road mats is the capability for wildlife traversing the mats to become injured due to the substantial joint gaps required and presented by the known road mats.

BRIEF SUMMARY OF THE INVENTION

The present invention solves one or more problems of the prior art. For example, the present invention provides a secure interlocking mechanism. Further, the present invention provides for ease of both placement and removal. Still further, the present invention presents a limited end gap that prevents wildlife injury and reduces the collection of debris in the interlocking joint.

The present invention is directed to a road mat including a mat body having a first coupling end and a second coupling end. A first locking mechanism is provided at the first coupling end that includes a male coupling member and a female coupling member. A second locking mechanism is provided at the second coupling end that includes a male coupling member and a female coupling member. In one preferred embodiment of the present invention the first locking mechanism is a reciprocating mirror image of the second locking mechanism.

The present invention also includes a road mat system that includes at least one prior road mat and at least one successive road mat. The second locking mechanism of the prior road mat is suitable for interlocking with the first locking mechanism of the successive road mat.

The foregoing and other objectives, features, and advantages of the invention will be more readily understood upon consideration of the following detailed description of the invention, taken in conjunction with the accompanying drawings.

DETAILED DESCRIPTION OF THE INVENTION

The present invention is directed to a road mat 10 (FIG. 1) that is preferably portable. Each road mat 10 includes a secure interlocking mechanism 24 at both ends. The secure interlocking mechanism 24 is a true interlocking structure (an interlocking joint) that allows for ease of both placement and removal. Two road mats 10 work together to form a road mat system (FIG. 2). Using the present invention two interlocked road mats 10 have substantially smooth top and bottom plate joints and only a limited end gap between the road mats 10. The smooth joints and limited end gap prevents wildlife injury and reduces the collection of debris in the interlocking joints.

Figure 1:
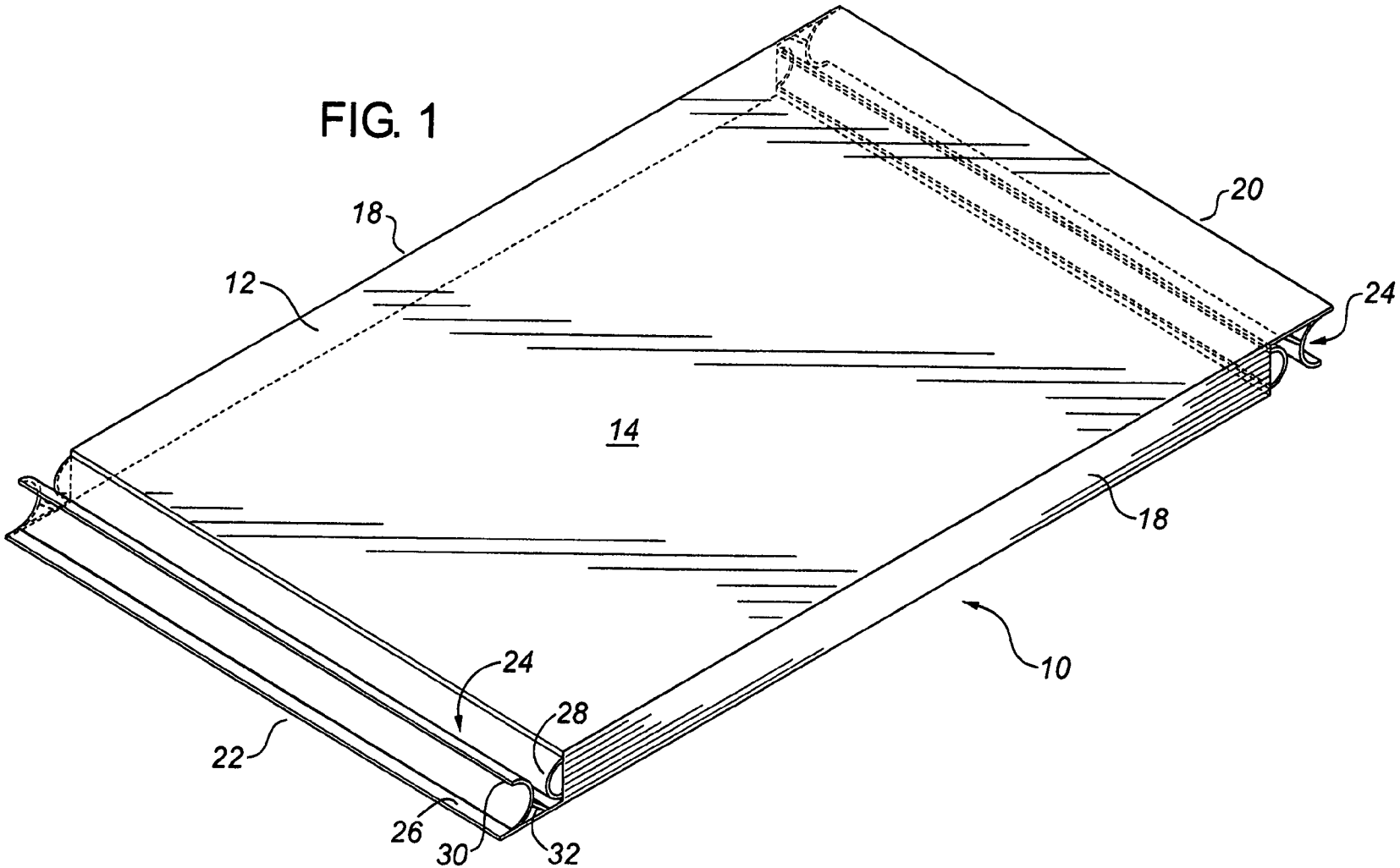
FIG. 1 is a perspective view of a road mat of the present invention with an end locking mechanism, a male coupling member, a female coupling member, a support/alignment plate, and an interlocking locating plate.
Figure 2:
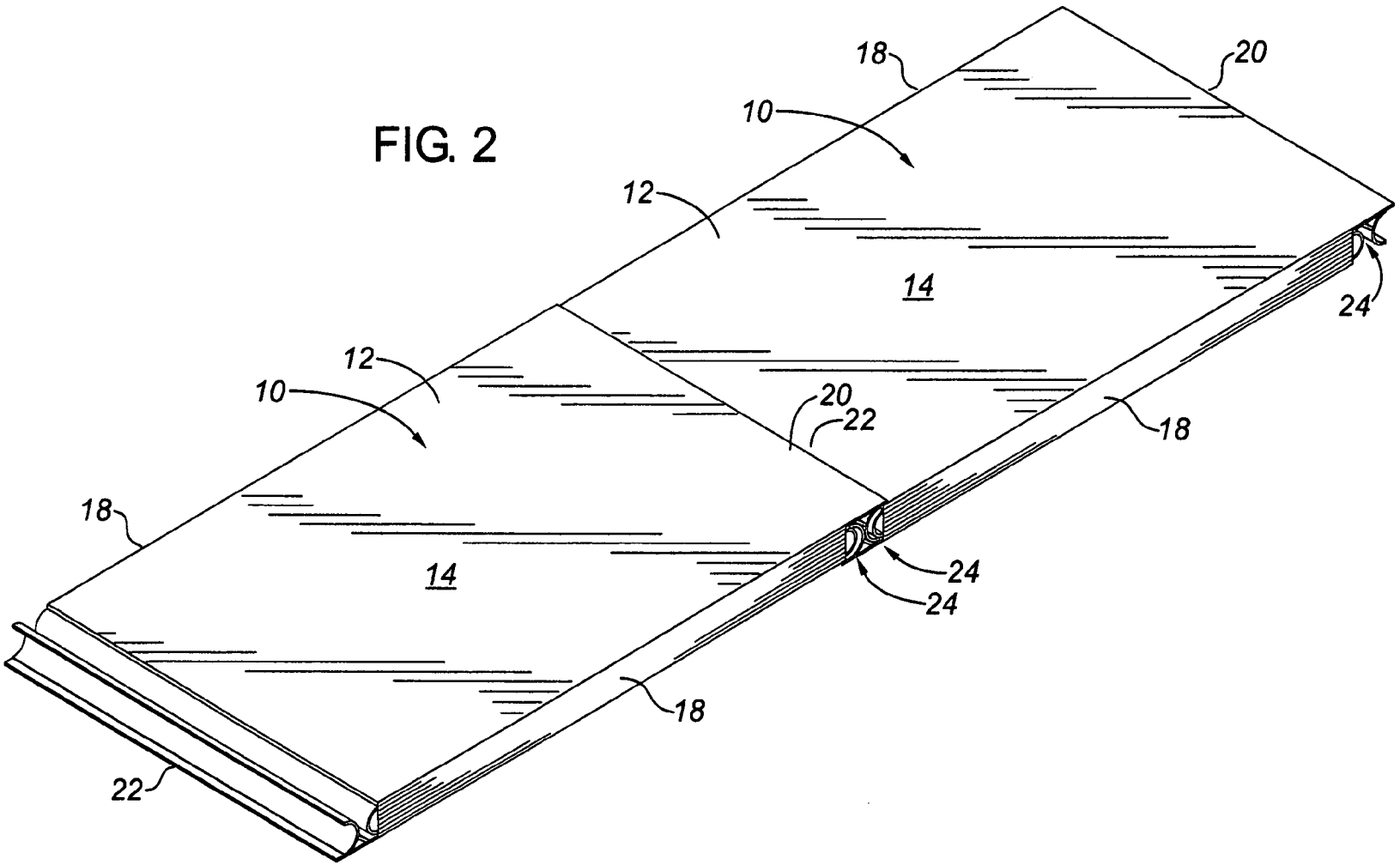
FIG. 2 is a perspective view of two road mats of the present invention joined with the reciprocating first end interlocking with reciprocating second end with the male coupling members, female coupling members, support/alignment plates, and interlocking locating plates fully interlocked.

Referring to FIG. 1, there is provided a road mat 10 that includes a mat body 12 having a top surface 14, a bottom surface 16 (FIGS. 3 and 4), and two side surfaces 18, a first coupling end 20, and a second coupling end 22. A locking mechanism 24 is provided at both the first coupling end 20 (the first locking mechanism 24) and the second coupling end 22 (the second locking mechanism 24). The second coupling end 22 is provided as a reciprocal end to the first coupling end 20 of the road mat 10.

FIG. 2 shows a first road mat 10 and a second road mat 10 that are coupled to form a temporary roadway with the locking mechanisms 24 fully engaged. Specifically, the first coupling end 20 of the first road mat 10 is coupled with the second coupling end 22 of the second road mat 10. This coupling allows for vertical displacement and simultaneously prevents separation of the two road mats.

Figure 3:
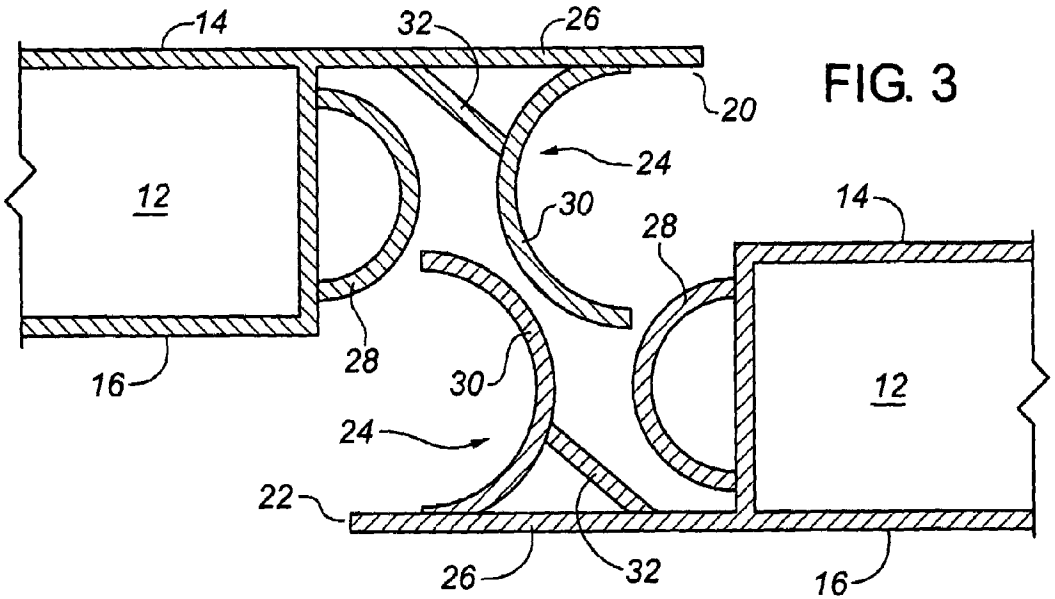
FIG. 3 is a cross-sectional side view of two road mats with the reciprocating ends in mirror image with interlocking road mat top and bottom locating plates, male coupling members, female coupling members, and support/alignment plates.
Figure 4:
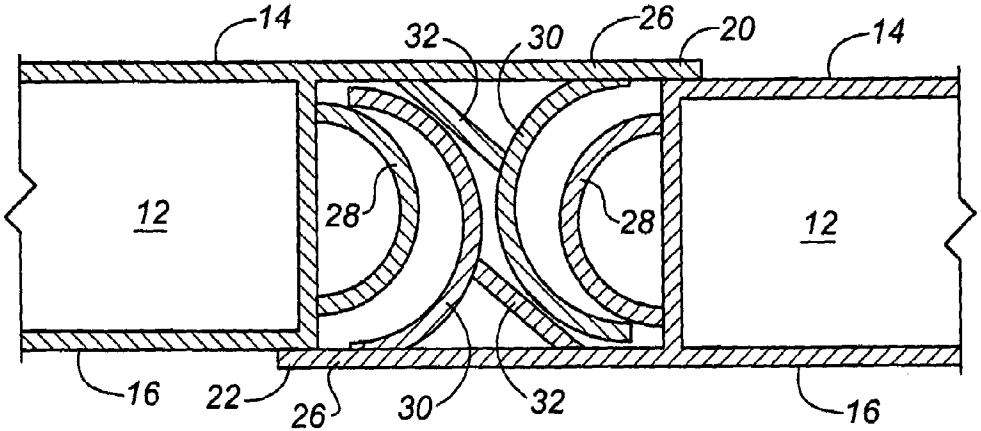
FIG. 4 is a cross-sectional side view of two road mats interlocked with the male coupling members interlocking with interlocking road mat top and bottom locating plates, male coupling members, female coupling members, and support/alignment plates.

FIGS. 3 and 4 show adjacent (FIG. 3) and interlocked (FIG. 4) detailed views of a first coupling end 20 (the first locking mechanism 24) of a first road mat 10 and a second coupling end 22 (the second locking mechanism 24) of a second road mat 10. Both figures show the first coupling end 20 having a top steel locating plate 26 (also called a kick plate), a male coupling member 28, a female coupling member 30, and a support/alignment plate 32. Both figures show the second coupling end 22 having a bottom steel locating plate 26 (also called a kick plate), a male coupling member 28, a female coupling member 30, and a support/alignment plate 32. Referring to FIG. 4, the first coupling end 20 and the second coupling end 22 are shown fully interlocked with female coupling members 30 fully interlocked with male coupling members 28 via the support/alignment plates 32. This exemplary proposed invention provides for a highly secure interlocking mechanism by virtue of the mating of the reciprocal coupling ends 20, 22.

In the shown embodiment, each coupling end 20, 22 includes a locking mechanism 24 having a large female coupling member 30 and a smaller male coupling member 28. Specifically, the shown embodiment of the invention includes of two smaller identical sized semi-circles (one at each coupling end 20, 22), created with one half circle acting as the male coupling member 28 and two larger identical sized semi-circles (one at each coupling end 20, 22), created with another half circle, acting as the female coupling member 30. Extending outward from the mat body 12 and perpendicularly from top and bottom surfaces 14, 16 of the mat body 12 are top and bottom steel locating plates 26. The male coupling member 28 is positioned substantially adjacent the end of the mat body 12. The female coupling member 30 is aligned and located to the end of the mat body 12 by way of a locating plate 26 and a support/alignment plate 32. On one coupling end 20 of the road mat 12, the locking mechanism 24 is aligned upright and on the other coupling end 22 of the same road mat 12, the locking mechanism 24 is aligned identically, but upside down.

This exemplary configuration allows the locking mechanisms 24 to align, mesh, and/or interlock securely and easily, on either placement or removal, in a reciprocating fashion (which also can be referred to as a reciprocating mirror image) allowing for continuous, infinite, addition of road mats 12 to the overall structure. This configuration of the coupling ends 20, 22 further allows for the mating and engaging of the reciprocal ends of a first road mat 10 and a second road mat 10 so that the intersection thereof allows for vertical displacement but prevents separation. This interlocking system further providing for dynamic rotation of the coupling ends 20, 22 in the vertical plane to allow for inconsistencies in the terrain without loss of coupling capability or strength.

Operation

The use and operation of road mats 10 will now be described with reference to FIGS. 1 through 4. Referring to FIG. 2, the road mats 10 are designed to be laid on ground surface in end to end relation and driven over by motor vehicles. The road mats 10 are fully secured together by interlocking mechanisms 24 of adjoining road mats 10.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims. For example, alternate embodiments of the invention may have variations in the shape and design of the male coupling member 28 and female coupling member 30. Further, although the shown and described preferred embodiment uses common and readily available materials, alternative embodiments could use less common materials or custom made components. It will be apparent to one skilled in the art that modifications may be made to the illustrated embodiment without departing from the spirit and scope of the invention as hereinafter defined in the claims.

The terms and expressions that have been employed in the foregoing specification are used as terms of description and not of limitation, and are not intended to exclude equivalents of the features shown and described or portions of them. The scope of the invention is defined and limited only by the claims that follow.

What is claimed is:

1. A road mat comprising:

(a) a mat body having a first coupling end and a second coupling end;

(b) a first locking mechanism provided at said first coupling end, said first locking mechanism comprising a male coupling member and a female coupling member, said male coupling member positioned substantially between said mat body and said female coupling member such that said mat body, said male coupling member, and said female coupling member are horizontally in tandem; and (c) a second locking mechanism provided at said second coupling end said second locking mechanism comprising a male coupling member and a female coupling member, said male coupling member positioned substantially between said mat body and said female coupling member such that said mat body, said male coupling member, and said female coupling member are horizontally in tandem;

(d) wherein said male coupling members and said female coupling members have a substantially semi-circular shape.

2. The road mat of claim 1 wherein said male coupling members interact to connect with said female coupling members of a successive mat body.

3. The road mat of claim 1 wherein said first locking mechanism is substantially parallel to said first coupling end and said second locking mechanism is substantially parallel to said second coupling end.

4. The road mat of claim 1 wherein said first locking mechanism extends substantially the length of said first coupling end and said second locking mechanism extends substantially the length of said second coupling end.

5. A road mat system comprising:

(a) at least one prior road mat and at least one successive road mat, each road mat comprising:

(i) a mat body having a first coupling end and a second coupling end;

(ii) a first locking mechanism provided at said first coupling end, said first locking mechanism comprising a male coupling member and a female coupling member, said male coupling member positioned substantially between said mat body and said female coupling member; and (iii) a second locking mechanism provided at said second coupling end said second locking mechanism comprising a male coupling member and a female coupling member, said male coupling member positioned substantially between said mat body and said female coupling member; and (b) said second locking mechanism of said prior road mat interlocks with said first locking mechanism of said successive road mat;

(c) wherein said at least one prior road mat and said at least one successive road mat are substantially identical.

6. The road mat system of claim 5 wherein said male coupling members interact with said female coupling members to connect successive road mats.

7. The road mat system of claim 5 wherein:

(a) said male coupling member of said second locking mechanism of said prior road mat interacts with said female coupling member of said first locking mechanism of said successive road mat; and (b) said female coupling member of said second locking mechanism of said prior road mat interacts with said male coupling member of said first locking mechanism of said successive road mat.

8. The road mat system of claim 5 wherein said first locking mechanism is substantially parallel to said first coupling end and said second locking mechanism is substantially parallel to said second coupling end.

9. The road mat system of claim 5 wherein said first locking mechanism extends substantially the length of said first coupling end and said second locking mechanism extends substantially the length of said second coupling end.

10. A road mat system comprising:

(a) at least one prior road mat and at least one successive road mat, each road mat comprising:

(i) a mat body having a first coupling end and a second coupling end;

(ii) a first locking mechanism provided at said first coupling end, said first locking mechanism comprising a male coupling member and a female coupling member, said male coupling member positioned substantially between said mat body and said female coupling member; and (iii) a second locking mechanism provided at said second coupling end said second locking mechanism comprising a male coupling member and a female coupling member, said male coupling member positioned substantially between said mat body and said female coupling member; and (b) said second locking mechanism of said prior road mat interlocks with said first locking mechanism of said successive road mat;

(c) wherein said first locking mechanism is a reciprocating mirror image of said second locking mechanism.

11. The road mat system of claim 10 wherein said male coupling members interact with said female coupling members to connect successive road mats.

12. The road mat system of claim 10 wherein:

(a) said male coupling member of said second locking mechanism of said prior road mat interacts with said female coupling member of said first locking mechanism of said successive road mat; and (b) said female coupling member of said second locking mechanism of said prior road mat interacts with said male coupling member of said first locking mechanism of said successive road mat.

13. The road mat system of claim 10 wherein said first locking mechanism is substantially parallel to said first coupling end and said second locking mechanism is substantially parallel to said second coupling end.

14. The road mat system of claim 10 wherein said first locking mechanism extends substantially the length of said first coupling end and said second locking mechanism extends substantially the length of said second coupling end.

15. A road mat system comprising:

(a) at least one prior road mat and at least one successive road mat, each road mat comprising:

(i) a mat body having a first coupling end and a second coupling end;

(ii) a first locking mechanism provided at said first coupling end, said first locking mechanism comprising a male coupling member and a female coupling member, said male coupling member positioned substantially between said mat body and said female coupling member; and (iii) a second locking mechanism provided at said second coupling end said second locking mechanism comprising a male coupling member and a female coupling member, said male coupling member positioned substantially between said mat body and said female coupling member; and (b) said second locking mechanism of said prior road mat interlocks with said first locking mechanism of said successive road mat;

(c) wherein said male coupling members and said female coupling members have a substantially semi-circular shape.

16. The road mat system of claim 15 wherein said male coupling members interact with said female coupling members to connect successive road mats.

17. The road mat system of claim 15 wherein:

(a) said male coupling member of said second locking mechanism of said prior road mat interacts with said female coupling member of said first locking mechanism of said successive road mat; and (b) said female coupling member of said second locking mechanism of said prior road mat interacts with said male coupling member of said first locking mechanism of said successive road mat.

18. The road mat system of claim 15 wherein said first locking mechanism is substantially parallel to said first coupling end and said second locking mechanism is substantially parallel to said second coupling end.

19. The road mat system of claim 15 wherein said first locking mechanism extends substantially the length of said first coupling end and said second locking mechanism extends substantially the length of said second coupling end.

20. A road mat system comprising:

(a) at least one prior road mat and at least one successive road mat, each road mat comprising:

(i) a mat body having a first coupling end and a second coupling end:

(ii) a first locking mechanism provided at said first coupling end, said first locking mechanism comprising a male coupling member and a female coupling member, said male coupling member positioned substantially between said mat body and said female coupling member; and (iii) a second locking mechanism provided at said second coupling end said second locking mechanism comprising a male coupling member and a female coupling member, said male coupling member positioned substantially between said mat body and said female coupling member; and (b) said second locking mechanism of said prior road mat interlocks with said first locking mechanism of said successive road mat;

(c) wherein said road mat system provides for dynamic rotation of the coupling ends in the vertical plane to allow for inconsistencies in the terrain without loss of coupling capability or strength.

21. The road mat system of claim 20 wherein said male coupling members interact with said female coupling members to connect successive road mats.

22. The road mat system of claim 20 wherein:

(a) said male coupling member of said second locking mechanism of said prior road mat interacts with said female coupling member of said first locking mechanism of said successive road mat; and (b) said female coupling member of said second locking mechanism of said prior road mat interacts with said male coupling member of said first locking mechanism of said successive road mat.

23. The road mat system of claim 20 wherein said first locking mechanism is substantially parallel to said first coupling end and said second locking mechanism is substantially parallel to said second coupling end.

24. The road mat system of claim 20 wherein said first locking mechanism extends substantially the length of said first coupling end and said second locking mechanism extends substantially the length of said second coupling end.

25. A road mat comprising:

(a) a mat body having a first coupling end and a second coupling end;

(b) a first locking mechanism provided at said first coupling end, said first locking mechanism comprising a male coupling member substantially parallel to said first coupling end and a female coupling member substantially parallel to said first coupling end, said mat body, said male coupling member, and said female coupling member positioned substantially horizontally in tandem; and (c) a second locking mechanism provided at said second coupling end said second locking mechanism comprising a male coupling member substantially parallel to said first coupling end and a female coupling member substantially parallel to said first coupling end, said mat body, said male coupling member, and said female coupling member positioned substantially horizontally in tandem;

(d) wherein said male coupling members and said female coupling members have a substantially semi-circular shape.

26. The road mat of claim 25 wherein said first locking mechanism extends substantially the length of said first coupling end and said second locking mechanism extends substantially the length of said second coupling end.

27. The road mat of claim 25 wherein in relation to each coupling end, said male coupling members are positioned in tandem with said female coupling members at each coupling end.

28. A road mat comprising:

(a) a mat body having a first coupling end and a second coupling end;

(b) a first locking mechanism provided at said first coupling end, said first locking mechanism comprising a male coupling member substantially parallel to said first coupling end and a female coupling member substantially parallel to said first coupling end, said mat body, said male coupling member, and said female coupling member positioned substantially horizontally in tandem; and (c) a second locking mechanism provided at said second coupling end said second locking mechanism comprising a male coupling member substantially parallel to said first coupling end and a female coupling member substantially parallel to said first coupling end, said mat body, said male coupling member, and said female coupling member positioned substantially horizontally in tandem;

(d) wherein said male coupling members and said female coupling members provide for dynamic rotation of the coupling ends in the vertical plane to allow for inconsistencies in the terrain without loss of coupling capability or strength.

29. The road mat of claim 28 wherein said first locking mechanism extends substantially the length of said first coupling end and said second locking mechanism extends substantially the length of said second coupling end.

30. The road mat of claim 28 wherein in relation to each coupling end, said male coupling members are positioned in tandem with said female coupling members at each coupling end.

31. A road mat comprising:

(a) a mat body having a first coupling end and a second coupling end;

(b) a first locking mechanism provided at said first coupling end, said first locking mechanism comprising a male coupling member and a female coupling member, said male coupling member positioned substantially between said mat body and said female coupling member such that said mat body, said male coupling member, and said female coupling member are horizontally in tandem; and (c) a second locking mechanism provided at said second coupling end said second locking mechanism comprising a male coupling member and a female coupling member, said male coupling member positioned substantially between said mat body and said female coupling member such that said mat body, said male coupling member, and said female coupling member are horizontally in tandem;

(d) wherein said male coupling members and said female coupling members are C-shaped channel members.

32. The road mat of claim 31 wherein said male coupling members interact to connect with said female coupling members of a successive mat body.

33. The road mat of claim 31 wherein said first locking mechanism is substantially parallel to said first coupling end and said second locking mechanism is substantially parallel to said second coupling end.

34. The road mat of claim 31 wherein said first locking mechanism extends substantially the length of said first coupling end and said second locking mechanism extends substantially the length of said second coupling end.

* * * * *